US006923626B2

(12) United States Patent
Ota et al.

(10) Patent No.: US 6,923,626 B2
(45) Date of Patent: Aug. 2, 2005

(54) VARIABLE DISPLACEMENT COMPRESSOR WITH DECELERATING MECHANISM FOR NOISE INHIBITION

(75) Inventors: Masaki Ota, Kariya (JP); Tomohiro Wakita, Kariya (JP); Tomoji Tarutani, Kariya (JP); Hirotaka Kurakake, Kariya (JP); Yoshinobu Ishigaki, Kariya (JP); Kazuhiro Nomura, Kariya (JP); Yoshinori Inoue, Kariya (JP); Satoshi Umemura, Kariya (JP); Kazuhiko Minami, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/210,772

(22) Filed: Aug. 1, 2002

(65) Prior Publication Data

US 2003/0026708 A1 Feb. 6, 2003

(30) Foreign Application Priority Data

Aug. 2, 2001 (JP) ..... 2001-235323
Apr. 24, 2002 (JP) ..... 2002-122487

(51) Int. Cl.[7] ..... F04B 1/29
(52) U.S. Cl. ..... 417/222.2
(58) Field of Search ..... 417/222.1, 222.2, 417/269; 91/494, 497, 499, 502, 503, 505, 506; 92/12, 12.1, 12.2, 13.5, 13.51, 67, 70, 71, 72, 73

(56) References Cited

U.S. PATENT DOCUMENTS 4,178,136 A 12/1979 Reid et al. ..... 417/269
6,213,728 B1 * 4/2001 Kato et al. ..... 417/222.2
6,250,891 B1 6/2001 Kawaguchi et al. ..... 417/222.2
2001/0033798 A1 * 10/2001 Ota et al. ..... 417/222.2
2002/0178906 A1 * 12/2002 Herder et al. ..... 92/71

FOREIGN PATENT DOCUMENTS

| | | | | |
|---|---|---|---|---|
| JP | 1-83185 | | 6/1989 | ..... F04B/27/08 |
| JP | 403015673 A | * | 1/1991 | |
| JP | 11-006478 | | 1/1999 | ..... F04B/27/08 |
| JP | 11-264371 | | 9/1999 | ..... F04B/27/08 |
| JP | 2000-018156 | | 1/2000 | ..... F04B/27/10 |
| JP | 2001-123944 | | 5/2001 | ..... F04B/27/10 |
| JP | 02001295757 A | * | 10/2001 | |
| JP | 2001-323874 | | 11/2001 | |
| WO | 00/58624 | | 10/2000 | |
| WO | 01/14743 A1 | | 3/2001 | |

* cited by examiner

*Primary Examiner*—Michael Koczo
(74) *Attorney, Agent, or Firm*—Morgan & Finnegan, LLP

(57) ABSTRACT

A variable displacement compressor has a housing, a drive shaft, a rotor, a swash plate, a piston and a decelerating mechanism. The housing includes a cylinder bore and supports the drive shaft. The rotor is secured to the drive shaft. The swash plate is operatively connected to the rotor and the drive shaft so as to rotate therewith and varies its inclination angle relative to the drive shaft. The piston is connected to the swash plate so as to reciprocate in the cylinder bore with rotation of the swash plate. A stroke of the piston varies in accordance with the inclination angle of the swash plate. The deceleration mechanism between the rotor and the swash plate decelerates the inclination speed of the swash plate in a range from a near maximum inclination angle to the maximum inclination angle when the swash plate inclines to increase the stroke of the piston.

12 Claims, 10 Drawing Sheets

VARIABLE DISPLACEMENT COMPRESSOR WITH DECELERATING MECHANISM FOR NOISE INHIBITION

BACKGROUND OF THE INVENTION

The present invention relates to a variable displacement compressor with a decelerating mechanism and a method of inhibiting noise from producing in a variable displacement compressor.

Japanese Unexamined Patent Publication No. 11-264371 discloses a swash plate type variable displacement compressor for use in a vehicular air conditioner. In the compressor, torque of a drive shaft is transmitted to a swash plate through a rotor secured to the drive shaft and a hinge mechanism. A piston connects with the swash plate through a pair of shoes. As the piston reciprocates in a cylinder bore in accordance with rotation of the swash plate, refrigerant gas introduced into the compressor is compressed and is discharged. Also, the swash plate is configured to slide on the drive shaft and to tilt relative to the drive shaft. The inclination angle of the swash plate relative to the drive shaft varies by adjusting pressure in a crank chamber that accommodates the swash plate by a control valve. Thereby, stroke of the piston and displacement of the compressor vary.

In the above-mentioned variable displacement compressor, the inclination angle of the swash plate upon maximum displacement operation, that is, the maximum inclination angle is regulated by contacting a stopper portion of the swash plate with a receiving portion of the rotor. Therefore, noise produces due to contact upon contacting, particularly just after starting the compressor, that is, upon switching from an OFF-state to a state of the maximum displacement, the swash plate collides with the rotor at relatively high speed, and relatively large noise is produced. Particularly, in a compressor having three cylinders (relatively small number of cylinders), there are multiple swash plate collisions. Additionally, a spring for reducing the inclination angle that urges the swash plate to reduce its inclination angle is generally interposed between the swash plate and the rotor. The spring for reducing the inclination angle is directed to maintain the minimum inclination angle of the swash plate upon stop of the compressor. Therefore, the spring cannot inhibit the above-mentioned noise produced by collision of the swash plate at relatively high speed. Accordingly, it is desired that noise produced when the swash plate collides with the rotor is reduced and inhibited.

SUMMARY OF THE INVENTION

In accordance with the present invention, a variable displacement compressor has a housing, a drive shaft, a rotor, a swash plate, a piston and a decelerating mechanism. The housing includes a cylinder bore and supports the drive shaft. The rotor is secured to the drive shaft. The swash plate is operatively connected to the rotor and the drive shaft so as to rotate with the rotor and the drive shaft and varies an inclination angle relative to the drive shaft. The piston is connected to the swash plate so as to reciprocate in the cylinder bore with rotation of the swash plate. A stroke of the piston varies in accordance with the inclination angle of the swash plate relative to the drive shaft. The decelerating mechanism is arranged between the rotor and the swash plate and decelerates the inclination speed of the swash plate in a range from a near maximum inclination angle to the maximum inclination angle when the swash plate inclines to increase the stroke of the piston.

The present invention also provides a method of inhibiting noise from being produced in a variable displacement compressor including a housing, a drive shaft supported by the housing, a cylinder bore, a crank chamber, a suction pressure region and a discharge pressure region respectively defined in the housing, a rotor secured to the drive shaft, a swash plate operatively connected to the rotor and the drive shaft so as to rotate with the rotor and the drive shaft, the swash plate varying an inclination angle relative to the drive shaft, and a piston connected to the swash plate so as to reciprocate in the cylinder bore with rotation of the swash plate, a control valve interposed in one of a supply passage that interconnects the discharge pressure region and the crank chamber and a bleed passage that interconnects the crank chamber and the suction pressure region, a decelerating mechanism arranged in-between the rotor and the swash plate. The method includes adjusting the opening degree of one of the supply passage and the bleed passage by the control valve, varying the inclination angle of the swash plate by pressure differential between the crank chamber and the cylinder bore, and decelerating inclination speed of the swash plate by the decelerating mechanism in a range from a near maximum inclination angle to the maximum inclination angle when the swash plate inclines to increase the stroke of the piston.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

A first embodiment of the present invention will now be described with reference to FIGS. 1 to 4. The left side and the right side in FIGS. 1 to 3 correspond to the front side and the rear side, respectively.

Figure 1:
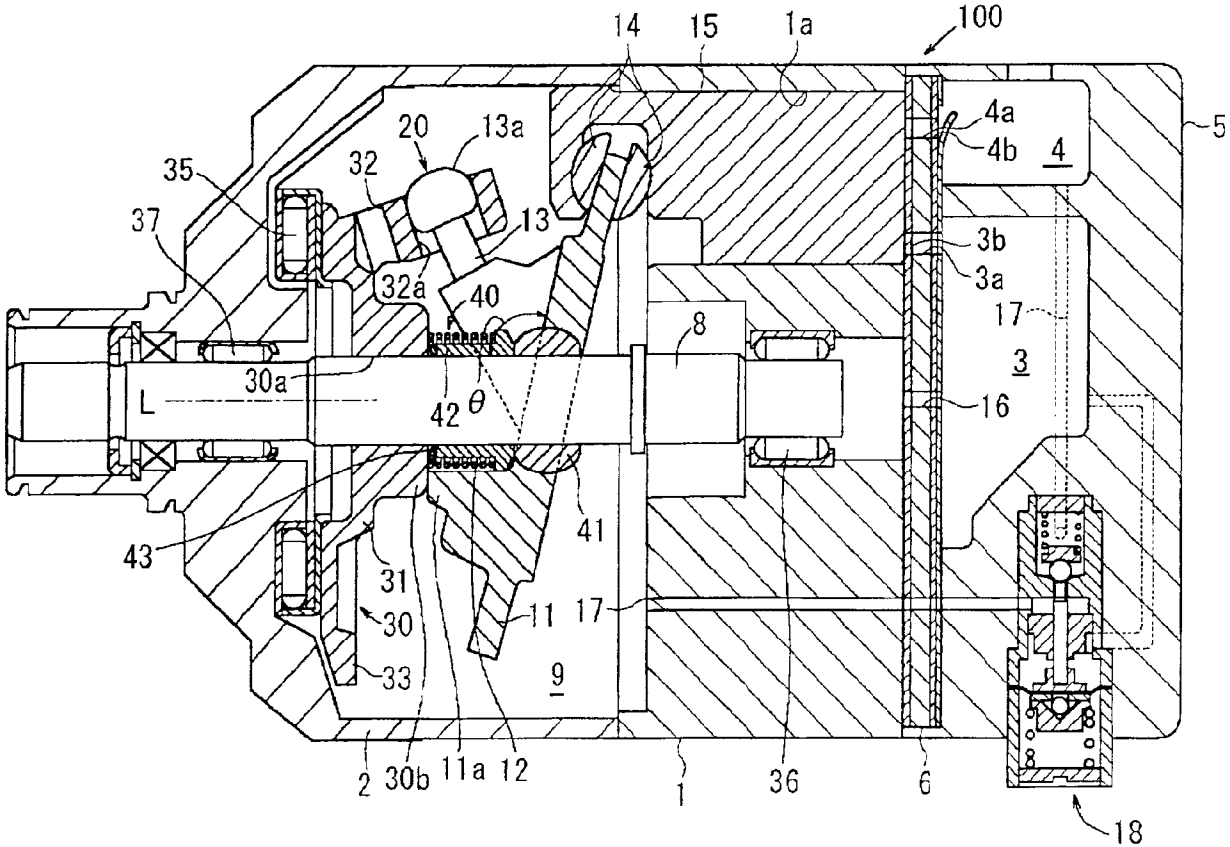
FIG. 1 is a longitudinal cross-sectional view of a variable displacement compressor according to a first embodiment of the present invention.
Figure 2:
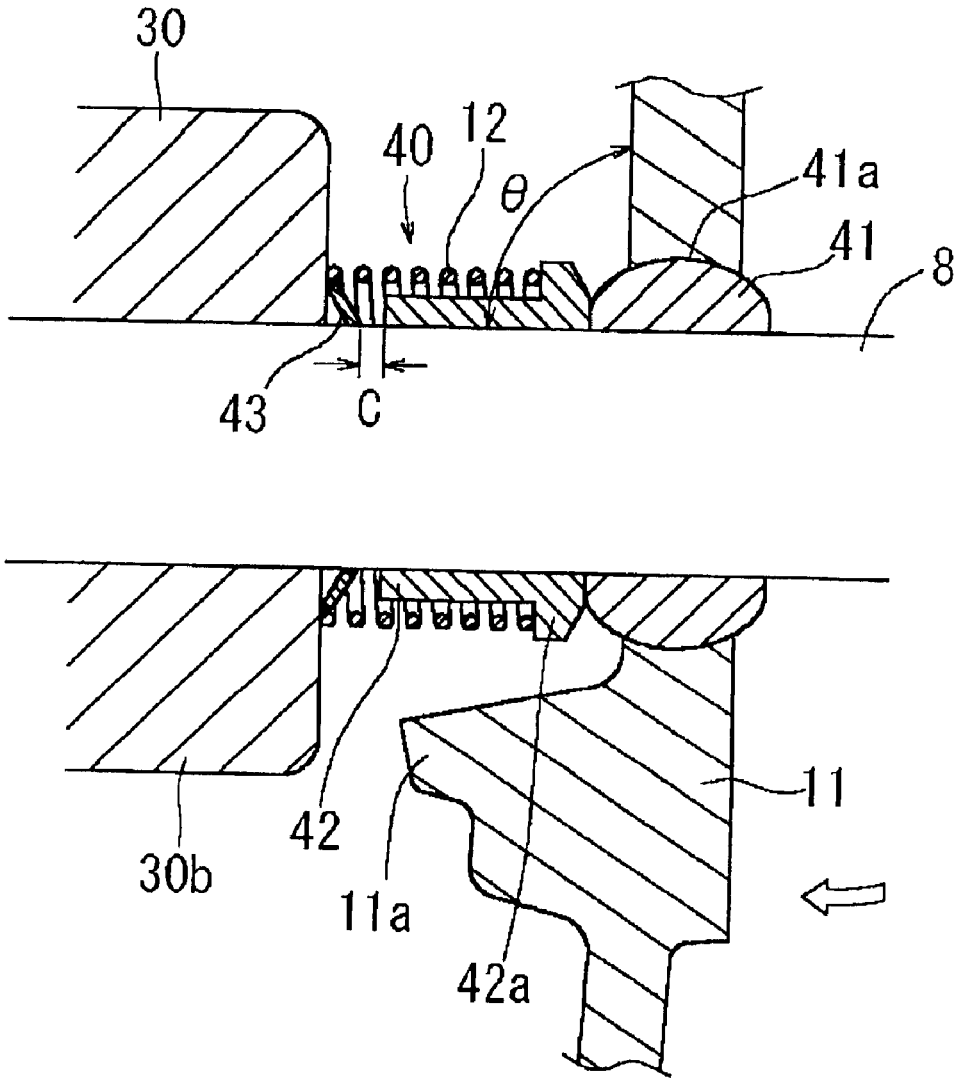
FIG. 2 is a partially enlarged cross-sectional view showing the minimum inclination angle of a swash plate in the variable displacement compressor according to the first embodiment of the present invention.
Figure 3:
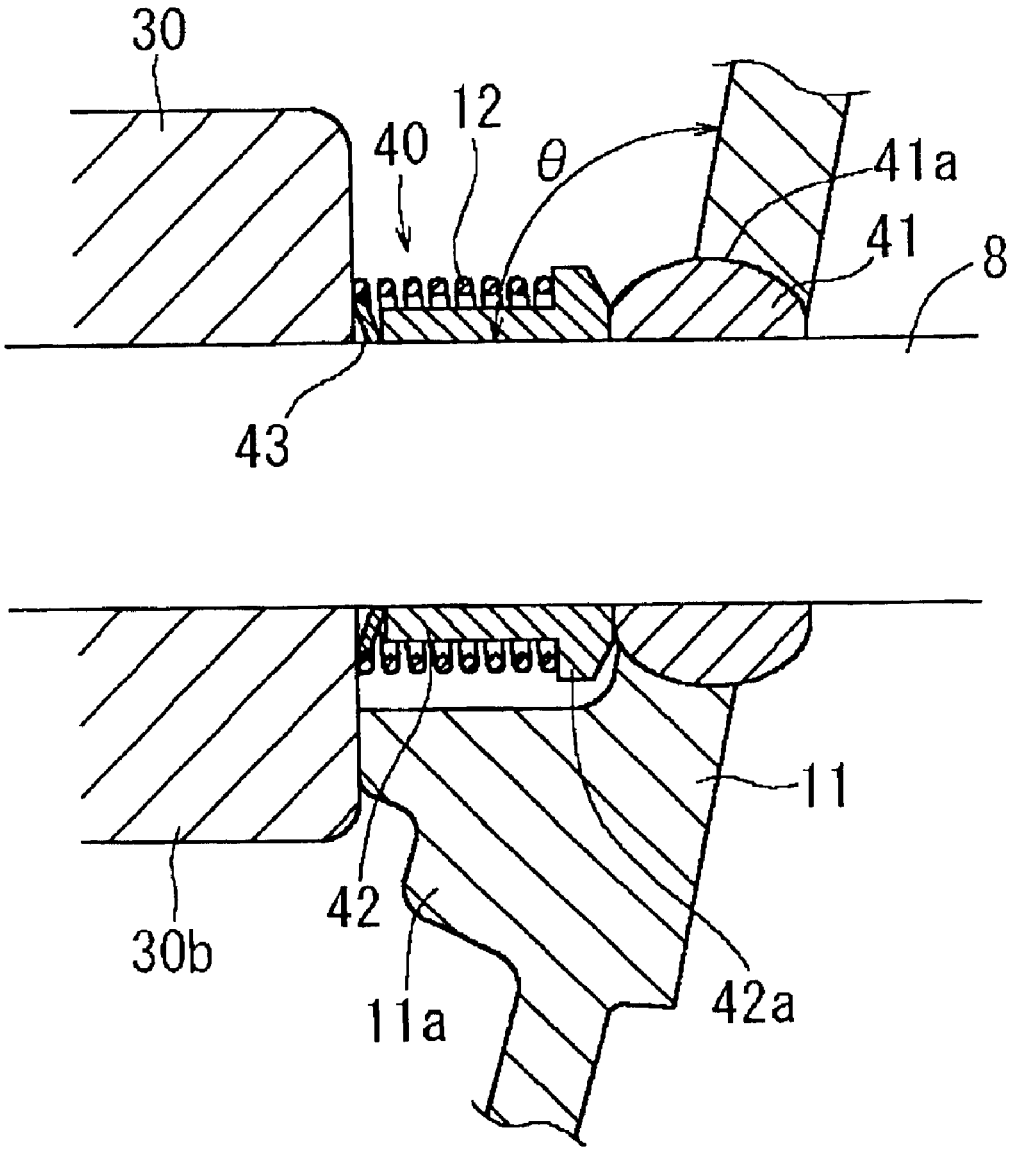
FIG. 3 is a partially enlarged cross-sectional view showing the maximum inclination angle of the swash plate in the variable displacement compressor according to the first embodiment of the present invention.

As shown in FIG. 1, a swash plate type variable displacement compressor 100 has a cylinder block 1, a front housing 2, a valve plate assembly 6 and a rear housing 5. The front housing 2 connects with the front end of the cylinder block 1. The rear housing 5 connects with the rear end of the cylinder block 1 through the valve plate assembly 6.

A suction chamber 3 and a discharge chamber 4 are defined in the rear housing 5. Refrigerant gas is introduced from the suction chamber 3, and compressed refrigerant gas is discharged to the discharge chamber 4. The valve plate assembly 6 forms a suction port 3*a* that interconnects the suction chamber 3 and a cylinder bore 1*a* through a suction valve 3*b* and a discharge port 4*a* that interconnects the discharge chamber 4 and the cylinder bore 1*a* through a discharge valve 4*b*. Additionally, the valve plate assembly 6 forms a bleed passage 16 that interconnects a crank chamber 9 in the front housing 2 and the suction chamber 3.

A drive shaft 8 connects with a vehicular engine or an external drive source through a clutch mechanism such as an electromagnetic clutch (not shown in the drawings) and extends through the cylinder block 1 and the front housing 2. Thereby, the drive shaft 8 is driven through the clutch mechanism upon operation of the vehicular engine. Additionally, the drive shaft 8 is rotatably supported by bearings 36 and 37, which are respectively arranged in the cylinder block 1 and the front housing 2.

A disc-shaped swash plate 11 is accommodated in the crank chamber 9. A pair of guide pins 13 having spherical portions 13*a* at their tip ends extends from the opposite side of the cylinder block 1. A rotor 30 is secured to the drive shaft 8 and rotates integrally with the drive shaft 8. The rotor 30 includes a circular rotary plate 31, and the rotary plate 31 includes a pair of support arms 32 and a balance weight 33. Additionally, the rotary plate 31 forms a through hole 30*a* for inserting the drive shaft 8.

The rotor 30 connects with the swash plate 11 through a hinge mechanism 20. Namely, the hinge mechanism 20 is constructed such that the support arms 32 on the rotor 30 side engage with the guide pins 13 on the swash plate 11 side. The support arms 32 each include support holes 32*a*, shape of which correspond to the spherical portions 13*a* of the guide pins 13. In a state that the spherical portions 13*a* of the guide pins 13 are respectively fitted into the support holes 32*a*, the support arms 32 respectively support the guide pins 13, while the guide pins 13 can respectively slide in the support holes 32*a*. Accordingly, the hinge mechanism 20, when the support arms 32 engage with the guide pins 13, transmits rotating torque of the drive shaft 8 to the swash plate 11 and also enables the swash plate 11 to incline relative to the drive shaft 8. Namely, the swash plate 11 is slidable and tiltable relative to the drive shaft 8.

A thrust bearing 35 is interposed between the rotor 30 and the front housing 2 and contacts with the front end of the rotary plate 31. Compression reactive force generated due to reciprocating motion of pistons 15 is received by the front housing 2 through the pistons 15, a pair of shoes 14, the swash plate 11, the hinge mechanism 20 and the thrust bearing 35.

The predetermined number of cylinder bores 1*a* is bored through the cylinder block 1 and is aligned in equiangular position in the circumferential direction. Each cylinder bore 1*a* slidably accommodates the respective piston 15. Additionally, the front ends of the pistons 15 each connect with the swash plate 11 through the pair of shoes 14. Thereby, as the swash plate 11 rotates in accordance with rotation of the drive shaft 8, each piston 15 reciprocates in the respective cylinder bore 1*a* due to rotation of the swash plate 11. Thus, as the pistons 15 reciprocate, refrigerant gas is introduced into the cylinder bore 1*a* in a suction process, and compressed refrigerant gas is discharged from the cylinder bore 1*a* in a discharge process.

The displacement of the compressor 100 is determined based on a stroke of the pistons 15, that is, a distance between a top dead center and a bottom dead center of the pistons 15. The stroke of the pistons 15 is determined based on the inclination angle of the swash plate 11. Namely, as the inclination angle θ of the swash plate 11 relative to the axis L of the drive shaft 8 increases, the stroke of the pistons 15 and the displacement of the compressor 100 increases. Meanwhile, as the inclination angle θ of the swash plate 11 reduces, the stroke of the pistons 15 and the displacement of the compressor 100 reduces. Also, upon operation of the compressor 100 the inclination angle θ of the swash plate 11 is determined based on pressure differential between the cylinder bores 1*a* and the crank chamber 9, and the pressure differential is adjusted by a control valve 18. Additionally, a coil spring 12 for reducing the inclination angle θ of the swash plate 11 is arranged between the swash plate 11 and the rotor 30, and the coil spring 12 urges the swash plate 11 to reduce its inclination angle θ.

The above-mentioned control valve 18 is interposed in a supply passage 17 that interconnects the discharge chamber 4 and the crank chamber 9 and that extends from the cylinder block 1 to the rear housing 5. The control valve 18 is an electromagnetic valve that adjusts the opening degree of the supply passage 17. Pressure in the crank chamber 9 varies by adjusting the opening degree of the supply passage 17. Thereby, pressure differential between the cylinder bores 1*a* and the crank chamber 9 is adjusted. Consequently, the inclination angle θ of the swash plate 11 relative to the drive shaft 8 varies, and the stroke of the pistons 15 varies, and then the displacement of the compressor 100 is adjusted. Also, for example, the control valve 18 may be interposed in the bleed passage 16. In such a state, pressure in the crank chamber 17 may vary by adjusting the opening degree of the bleed passage 16.

A decelerating mechanism 40 is arranged between the rotor 30 and the swash plate 11. The decelerating mechanism 40 is provided separately from the coil spring 12. The decelerating mechanism 40 includes a sliding member 42 and a coned disc decelerating spring 43. The sliding member 42 is arranged to slide along the direction of the axis L of the drive shaft 8. The decelerating spring 43 is arranged between the sliding member 42 and the rotor 30.

The coil spring 12 is arranged between a flange 42*a* of the sliding member 42 and the rear end of the rotor 30 around the sliding member 42. The sliding member 42 is urged toward the swash plate 11 by the coil spring 12 and contacts with a sleeve 41. The radially outer end of the sleeve 41 supports the swash plate 11. Additionally, the sleeve 41 slidably fits around the drive shaft 8 and tiltably supports the swash plate 11 by means of its outer spherical portion 41*a*.

Figure 4:
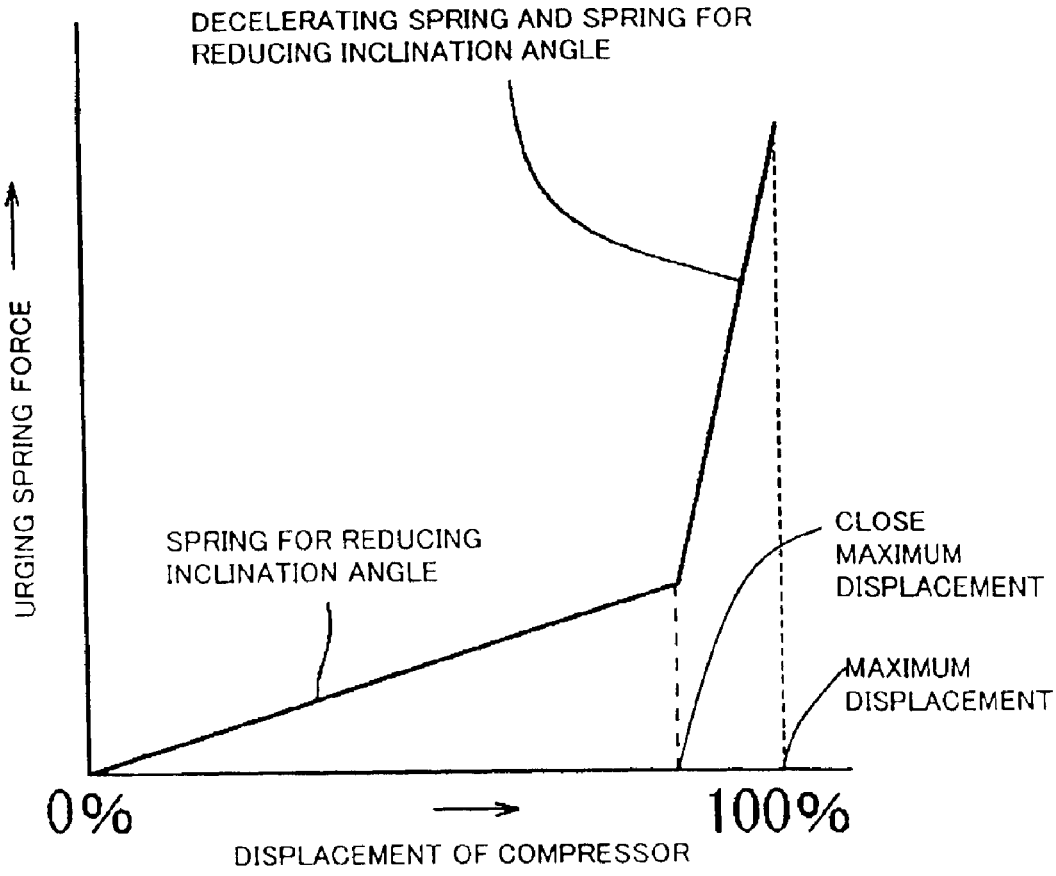
FIG. 4 is a graph indicating spring characteristics.

As shown in FIG. 4, the spring constant of the decelerating spring 43 is greater than that of the coil spring 12. When the displacement of the compressor 100 is in a relatively small range including stop of the compressor 100, that is, when the inclination angle θ of the swash plate 11 is relatively small, the decelerating spring 43 maintains a predetermined distance C from the axial end of the sliding member 42. As the sliding member 42 moves in accordance with an increase of the inclination angle θ of the swash plate 11, the decelerating spring 43 contacts with the axial end of the sliding member 42 in a range of a near maximum inclination angle.

As the sleeve 41 moves in accordance with an increase of the inclination angle θ of the swash plate 11, the sliding member 42 moves in the direction to increase the inclination angle θ while compressing the coil spring 12 that has a smaller spring constant than that of the decelerating spring 43. When the inclination angle θ of the swash plate 11 reaches the near maximum inclination angle, that is, when the displacement of the compressor 100 reaches the near maximum displacement, the sliding member 42 contacts with the decelerating spring 43. After that the urging force of the decelerating spring 43 having relatively great spring constant resists against the movement of the sliding member 42, as shown in FIG. 4 that indicates characteristics of the springs 12 and 43. Namely, the decelerating spring 43 decelerates the inclination speed of the swash plate 11 by resisting against the inclination of the swash plate 11 in the range from the near maximum inclination angle to the maximum inclination angle. Then the urging force of the decelerating spring 43 increases in proportion to an increase of the inclination of the swash plate 11.

As described above, according to the first embodiment, since the inclination speed of the swash plate 11 from a near maximum inclination to a maximum inclination angle is decelerated by the urging force of the decelerating spring 43, for example, upon starting the compressor 100, the swash plate 11 is inhibited from inclining to the maximum inclination angle when the displacement of the compressor rapidly increases from an OFF-state to a state of the maximum displacement. Thereby, noise of collision upon contacting a stopper portion 11*i* a of the swash plate 11 with a receiving portion 30*b* of the rotor 30 is reduced and inhibited, and the compressor 100 quietly operates. Also, since the decelerating spring 43 that directly restricts the inclination of the swash plate 11 is arranged between the drive shaft 8 and the swash plate 11, the decelerating mechanism 40 is simple and effective.

In the first embodiment, the maximum inclination angle of the swash plate 11 is determined by contacting the stopper portion 11*a* of the swash plate 11 with the receiving portion 30*b* of the rotor 30. However, the maximum inclination angle may be regulated not by contacting the stopper portion 11*a* with the receiving portion 30*b* but by the maximum compressed decelerating spring 43, that is, by rigidity of the decelerating spring 43.

When such a structure is applied, for example, vibration of the compressor 100 is reduced and inhibited when the compressor 100 operates in the maximum displacement. Namely, when the compressor 100 operates in the maximum displacement upon contacting the stopper portion 11*a* with the receiving portion 30*b*, compression reactive force applied to the pistons 15 are periodically transmitted to the front housing 2 through the swash plate 11, the rotor 30 and the thrust bearing 35. Consequently, the compressor 100 may vibrate as a whole. Therefore, when the maximum inclination angle of the swash plate 11 is regulated by the maximum compressed decelerating spring 43, the decelerating spring 43 damps vibration transmitted between the swash plate 11 and the rotor 30 in the range of deformation of the decelerating spring 43, and vibration is inhibited from being transmitted to the front housing 2. Thereby, vibration of the compressor 100 is inhibited.

Also, the decelerating mechanism 40 according to the first embodiment can be applied to a general variable displacement compressor with five to seven cylinders. Particularly, when applied to a variable displacement compressor with relatively small number of cylinders, for example, three cylinder bores la arranged around the drive shaft 8, that is, a variable displacement compressor with three cylinders, the decelerating mechanism 40 is effective. When in three cylinders, the swash plate 11 violently collides with the rotor 30 upon starting the compressor, and collision also tends to be repeated, as compared with the variable displacement compressor with five to seven cylinders.

A second embodiment of the present invention will now be described with reference to FIG. 5.

A structure of a compressor in the second embodiment is mostly the same as those of the compressor 100 in the first embodiment. Only components that are different from those of the first embodiment will be described. The same reference numerals denote the similar components in FIG. 5.

Figure 5:
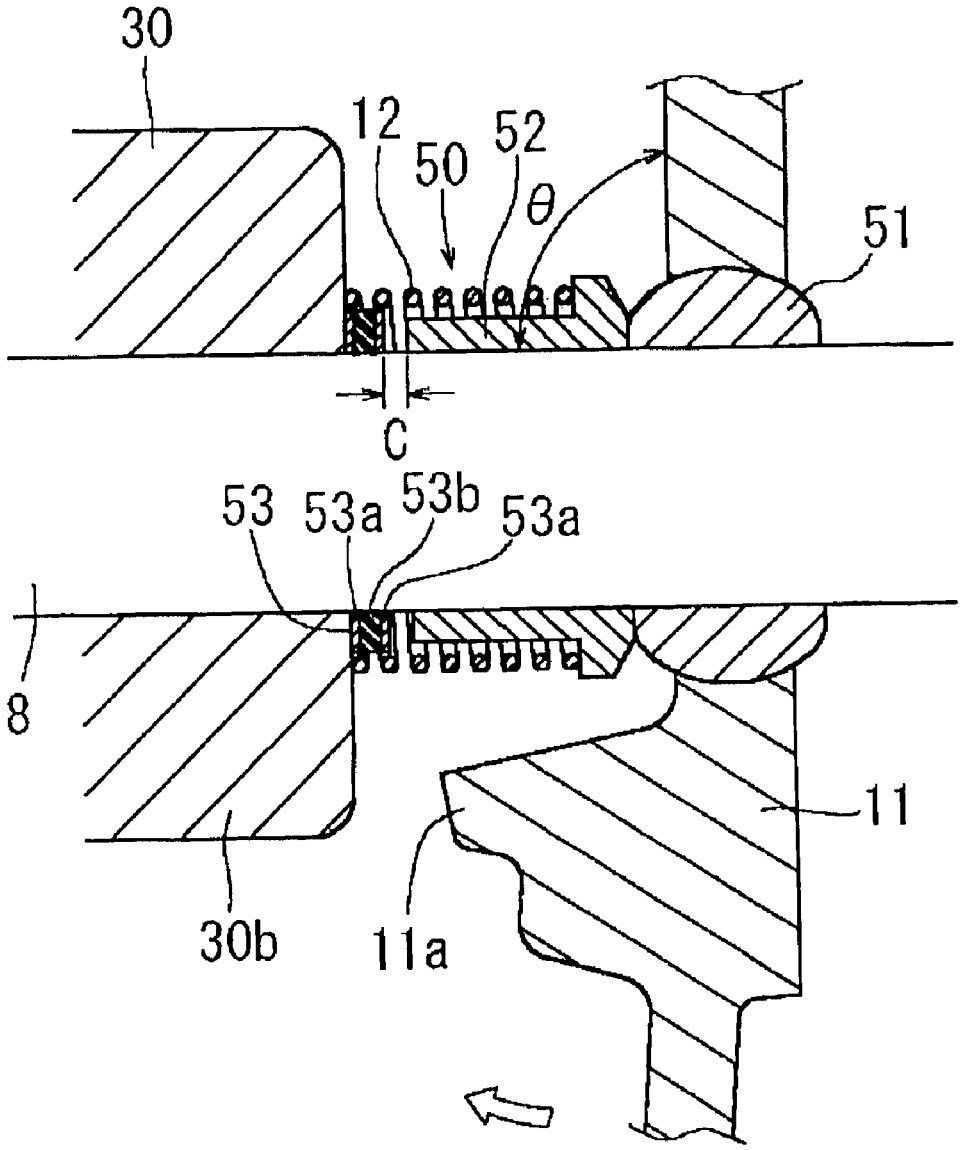
FIG. 5 is a partially enlarged cross-sectional view of a variable displacement compressor according to a second embodiment of the present invention.

As shown in FIG. 5, a decelerating mechanism 50 is arranged between the drive shaft 8 and the swash plate 11. The decelerating mechanism 50 includes a vibration damping washer 53 in place of the coned disc decelerating spring 43 described in the first embodiment. Except for it, the decelerating mechanism 50 is constructed as those of the first embodiment. Namely, the decelerating mechanism 50 includes a sliding member 52 and the vibration damping washer 53. The sliding member 52 is arranged in the vicinity of the rotor 30 side of a sleeve 51 that tiltably supports the swash plate 11. The vibration damping washer 53 is arranged between the sliding member 52 and the rotor 30.

The vibration damping washer 53 includes two steel plates 53*a* and rubber or resin 53*b*, which are layered, and the vibration damping washer 53 is ring-shaped or cylinder-shaped The vibration damping washer 53 is arranged between the rotor 30 and the sliding member 52 at a predetermined distance C from the sliding member 52 upon stop of the compressor 100. As the sliding member 52 moves in accordance with an increase of the inclination angle θ of the swash plate 11, the vibration damping washer 53 contacts with the axial end of the sliding member 52 in a range of a near inclination angle.

Thereby, as the sleeve 51 moves in accordance with an increase of the inclination angle θ of the swash plate 11, the sliding member 52 moves in the direction to increase the inclination angle θ while compressing the coil spring 12. When the inclination angle θ of the swash plate 11 reaches a near maximum inclination angle, that is, when the displacement of the compressor 100 reaches the near maximum displacement, the sliding member 52 contacts with the vibration damping washer 53. After that the urging force of the vibration damping washer 53 resists against the inclination to increase the inclination angle θ of the swash plate 11 due to elastic deformation of the vibration damping washer 53. Namely, the vibration damping washer 53 decelerates the inclination speed of the swash plate 11 by resisting against the inclination of the swash plate 11 in the range from the near maximum inclination angle to the maximum inclination angle.

According to the second embodiment that employs the vibration damping washer 53, noise of collision upon contacting the stopper portion 11*a* of the swash plate 11 with the receiving portion 30*b* of the rotor 30 is effectively reduced and inhibited when the inclination angle θ of the swash plate 11 rapidly increases from the minimum inclination angle to the maximum inclination angle upon starting the compressor.

Also, in such a state, the maximum inclination angle of the swash plate 11 can be determined by the maximum compressed vibration damping washer 53, that is, by rigidity of the vibration damping washer 53. Then, the vibration damping washer 53 inhibits compression reactive force applied to the pistons 15 from being periodically transmitted to the front housing 2 in the range of elastic deformation of the vibration damping washer 53. Thereby, vibration of the compressor is inhibited.

A third embodiment of the present invention will now be described with reference to FIG. 6.

A structure of a compressor in the third embodiment is mostly the same as those of the compressor 100 in the first embodiment. Only components that are different from those of the first embodiment will be described. The same reference numerals denote the similar components in FIG. 6.

Figure 6:
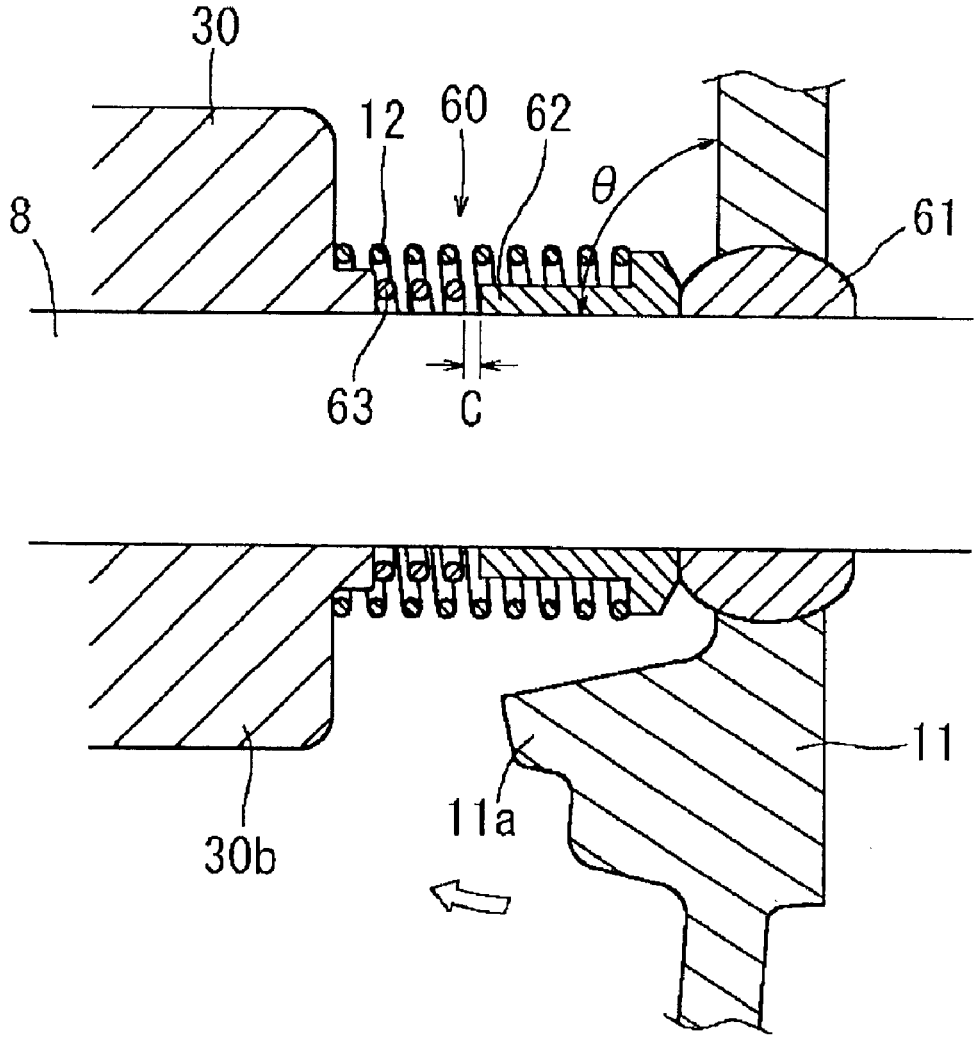
FIG. 6 is a partially enlarged cross-sectional view of a variable displacement compressor according to a third embodiment of the present invention.

As shown in FIG. 6, a decelerating mechanism 60 is arranged between the drive shaft 8 and the swash plate 11. The decelerating mechanism 60 includes a decelerating coil spring 63 in place of the coned disc decelerating spring 43 described in the first embodiment. The spring constant of the decelerating spring 63 is greater than that of the coil spring 12. Except for it, the decelerating mechanism 60 is constructed as those of the first embodiment. Namely, the decelerating mechanism 60 includes a sliding member 62 and the decelerating spring 63. The sliding member 62 is arranged in the vicinity of the rotor 30 side of a sleeve 61 that tiltably supports the swash plate 11. The decelerating spring 63 is arranged between the rotor 30 and the sliding member 62 at a predetermined distance C from the sliding member 62 upon stop of the compressor. When the inclination angle θ of the swash plate 11 reaches the near maximum inclination angle, that is, when the displacement of the compressor reaches the near maximum displacement, the sliding member 62 contacts with the decelerating spring 63.

Thereby, as the sleeve 61 moves in accordance with an increase of the inclination angle θ of the swash plate 11, the sliding member 62 moves in the direction to increase the inclination angle θ while compressing the coil spring 12. When the inclination angle θ of the swash plate 11 reaches a near maximum inclination angle, that is, when the displacement of the compressor reaches the near maximum displacement, the sliding member 62 contacts with the decelerating spring 63. After that the urging force of the decelerating spring 63 resists against the inclination to increase the inclination angle θ of the swash plate 11. Namely, the decelerating spring 63 decelerates the inclination speed of the swash plate 11 by resisting against the inclination of the swash plate 11 in the range from the near maximum inclination angle to the maximum inclination angle.

According to the third embodiment, for example, even when the inclination angle θ of the swash plate 11 rapidly increases from the minimum inclination angle to the maximum inclination angle upon starting the compressor, noise of collision upon contacting the swash plate 11 with the rotor 30 is effectively reduced and inhibited.

In such a state, the maximum inclination angle of the swash plate 11 can be determined by the maximum compressed decelerating spring 63, that is, by rigidity of the decelerating spring 63. Then, the decelerating spring 63 inhibits compression reactive force applied to the pistons 15 from being periodically transmitted to the front housing 2 in the range of elastic deformation of the decelerating spring 63. Thereby, vibration of the compressor is inhibited.

A fourth embodiment of the present invention will now be described with reference to FIG. 7.

A structure of a compressor in the fourth embodiment is mostly the same as those of the compressor 100 in the first embodiment. Only components that are different from those of the first embodiment will be described. The same reference numerals denote the similar components in FIG. 7.

Figure 7:
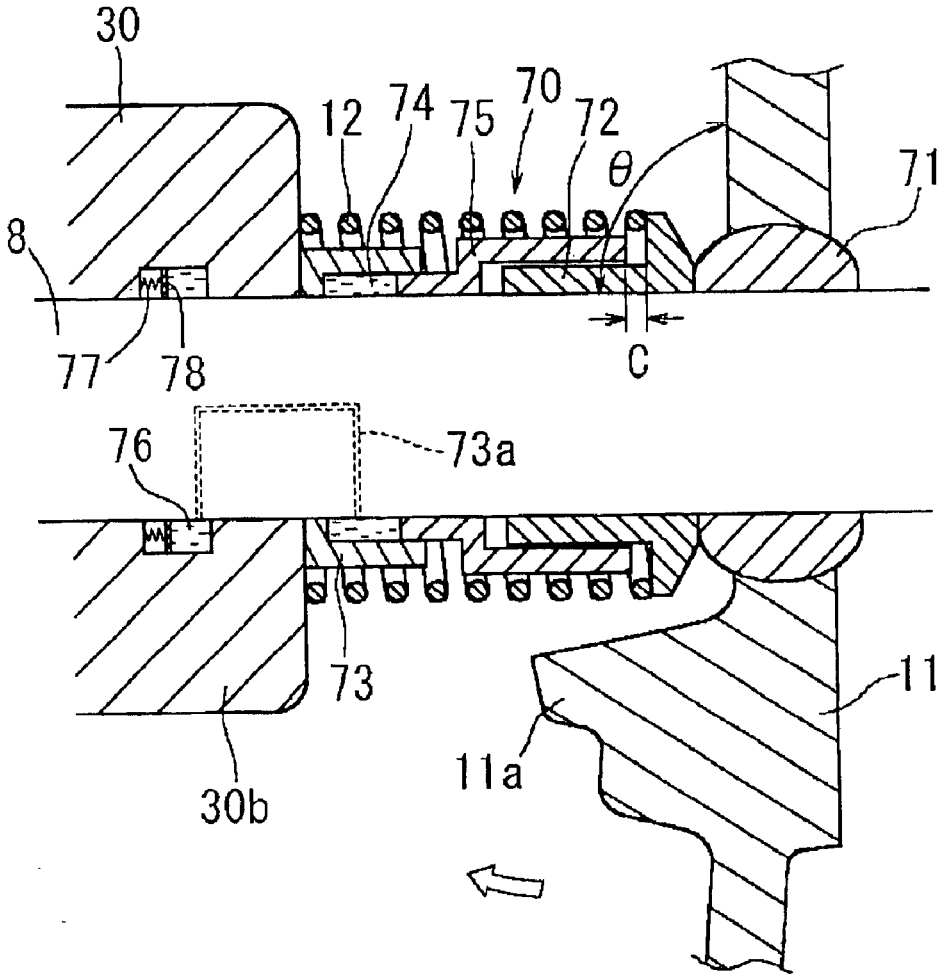
FIG. 7 is a partially enlarged cross-sectional view of a variable displacement compressor according to a fourth embodiment of the present invention.

As shown in FIG. 7, a decelerating mechanism 70 is arranged between the drive shaft 8 and the swash plate 11. The decelerating mechanism 70 includes a sliding member 72, a cylinder 73, fluid 74 and a hydraulic piston 75. The sliding member 72 is arranged in the vicinity of the rotor 30 side of a sleeve 71 that supports the swash plate 11. The cylinder 73 is secured to the drive shaft 8. The fluid 74 is enclosed in the cylinder 73. The piston 75 for pressing the fluid 74 is accommodated in the cylinder 73. A chamber in the cylinder 73 filled with the fluid 74 connects with a reservoir 76 defined in the rotor 30 through a passage 73*a* in the drive shaft 8. An annular plate 78, which is urged by a return spring 77 for pushing back the fluid 74 toward the chamber in the cylinder 73, is accommodated in the reservoir 76 so as to slide in the direction of the axis L of the drive shaft 8.

The piston 75 faces the sliding member 72 in the direction of the axis L at a predetermined distance C from the sliding member 72 upon stop of the compressor. The sliding member 72 moves in the direction to increase the inclination angle θ of the swash plate 11. When the inclination angle θ of the swash plate 11 reaches the near maximum inclination angle, the sliding member 72 contacts with the piston 75.

Therefore, as the sleeve 71 moves in accordance with an increase of the inclination angle θ of the swash plate 11, the sliding member 72 moves to increase the inclination angle θ while compressing the coil spring 12. When the inclination angle θ of the swash plate 11 reaches the near maximum inclination angle, that is, when the displacement of the compressor reaches the near maximum displacement, the sliding member 72 pushes the fluid 74 in the cylinder 73 by contacting with the piston 75. Thereby, the fluid 74 in the cylinder 73 flows into the reservoir 76 through the passage 73*a*. Then the nearly constant fluid static pressure of the fluid 74 is applied to the piston 75. Namely, constant damping resistance is applied to the piston 75, and not only the sliding speed of the sliding member 72 but also the inclination speed of the swash plate 11 is restricted.

The decelerating mechanism 70 according to the fourth embodiment decelerates the inclination speed of the swash plate 11 by utilizing damping resistance of the fluid 74. The decelerating mechanism 70 is what is called a damping mechanism. For example, as the diameter of the passage 73 becomes smaller, damping resistance increases. Consequently, damping resistance applied to the sliding member 72 increases when the fluid 74 flows between the cylinder 73 and the reservoir 76.

In the fourth embodiment, the damping force due to the flow resistance of the fluid 74 resists against the inclination of the swash plate 11. For example, noise of collision upon contacting the swash plate 11 with the rotor 30 is effectively reduced and inhibited when the inclination angle θ of the swash plate 11 rapidly increases from the minimum inclination angle to the maximum inclination angle upon starting the compressor.

Figure 8:
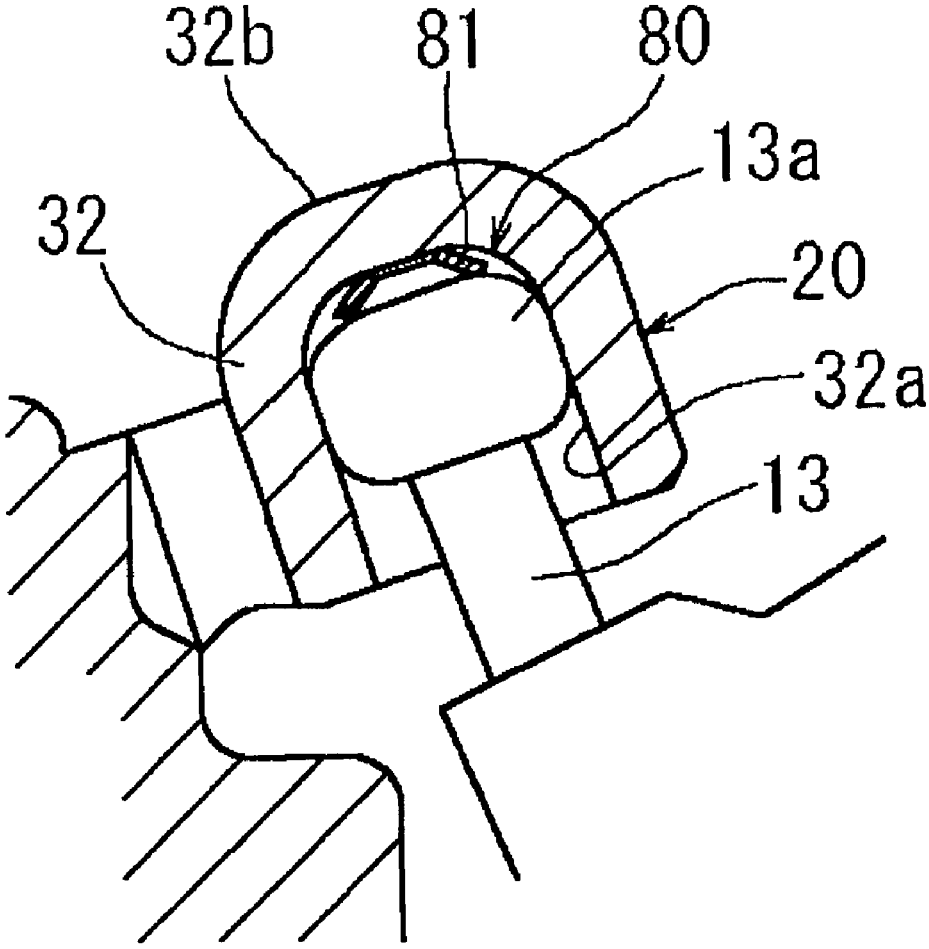
FIG. 8 is a partially enlarged cross-sectional view of a variable displacement compressor according to a fifth embodiment of the present invention.

A fifth embodiment of the present invention will now be described with reference to FIG. 8.

A structure of a compressor in the fifth embodiment is mostly the same as those of the compressor 100 in the first embodiment. Only components that are different from those of the first embodiment will be described. The same reference numerals denote the similar components in FIG. 8.

In the fifth embodiment, a decelerating mechanism 80 is arranged between the pair of guide pins 13 and the pair of support arms 32, that is, between a swash plate side member and a rotor side member in the hinge mechanism 20. The decelerating mechanism 80 mainly includes a decelerating spring 81 made of a coned disc spring as well as that of the first embodiment. Support holes 32*a* of the support arms 32, with which the spherical portions 13*a* of the guide pins 13 engage, are capped by cap portions 32*b*, and the decelerating springs 81 are respectively arranged between the cap portions 32*b* and the spherical portions 13*a*. The decelerating springs 81 respectively face the cap portions 32*b* at a predetermined distance from the cap portions 32*b* upon stop of the compressor. The guide pins 13 moves in accordance with an increase of the inclination angle θ of the swash plate 11. When the inclination angle θ of the swash plate 11 reaches a near maximum inclination angle, the decelerating spring 81 respectively contact with cap portions 32*b*.

Therefore, the spherical portions 13*a* of the guide pins 13 slide in the support holes 32*a* of the support arms 32 in accordance with an increase of the inclination angle θ of the swash plate 11. When the inclination angle θ of the swash plate 11 reaches a near maximum inclination angle, that is, when the displacement of the compressor reaches the near maximum displacement, the decelerating springs 81 respectively contact with the cap portions 32*b*. After that the urging force of the decelerating springs 81 resists against the inclination of the swash plate 11. Namely, the decelerating springs 81 decelerate the inclination speed of the swash plate 11 by resisting against the inclination of the swash plate 11 in the rang from the near maximum inclination angle to the maximum inclination angle.

According to the fifth embodiment, when the decelerating mechanism 80 is arranged in the hinge mechanism 20 noise of collision upon contacting the swash plate 11 with the rotor 30 is effectively reduced and inhibited upon starting the compressor, as well as that of the first embodiment. The maximum compressed decelerating springs 81 may regulate the maximum inclination angle of the swash plate 11 by rigidity of the decelerating springs 81. Thereby, compression reactive force applied to the pistons 15 is effectively inhibited from being periodically transmitted to the front housing 2, as well as that of the first embodiment.

Figure 9:
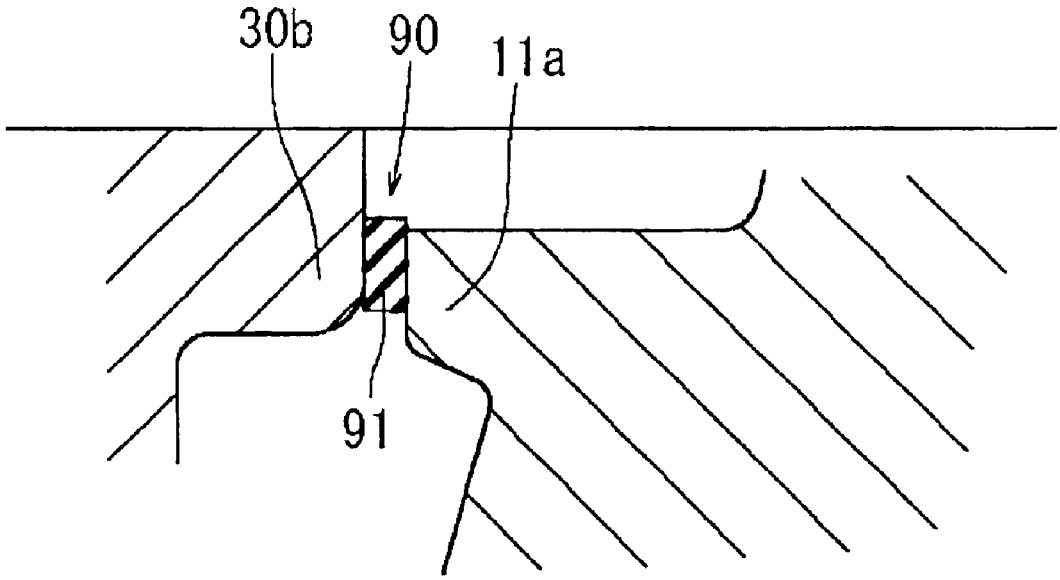
FIG. 9 is a partially enlarged cross-sectional view of a variable displacement compressor according to a sixth embodiment of the present invention.

A sixth embodiment of the present invention will now be described with reference to FIG. 9.

A structure of a compressor in the sixth embodiment is mostly the same as those of the compressor 100 in the first embodiment. Only components that are different from those of the first embodiment will be described. The same reference numerals denote the similar components in FIG. 9.

In the sixth embodiment, a decelerating mechanism 90 includes an elastic member 91. The elastic member 91 made of one of rubber and resin is interposed between contact surfaces of the stopper portion 11*a* of the swash plate 11 and the receiving portion 30*b* of the rotor 30. The elastic member 91, for example, adheres to the contact surface of the receiving member 30*b*. When the inclination angle θ of the swash plate 11 increases and reaches the near maximum inclination angle, the stopper portion 11*a* of the swash plate 11 contacts with the elastic member 91. Then collision is absorbed by elastic deformation of the elastic member 91. Namely, the decelerating mechanism 90 according to the sixth embodiment reduces and inhibits noise of collision by elastic deformation of the elastic member 91. Damping performance can be adjusted by selecting material and hardness and adjusting contact area.

A seventh embodiment of the present invention will now be described with reference to FIG. 10.

A structure of a compressor in the seventh embodiment is mostly the same as those of the compressor 100 in the first embodiment. Only components that are different from those of the first embodiment will be described. The same reference numerals denote the similar components in FIG. 10.

Figure 10:
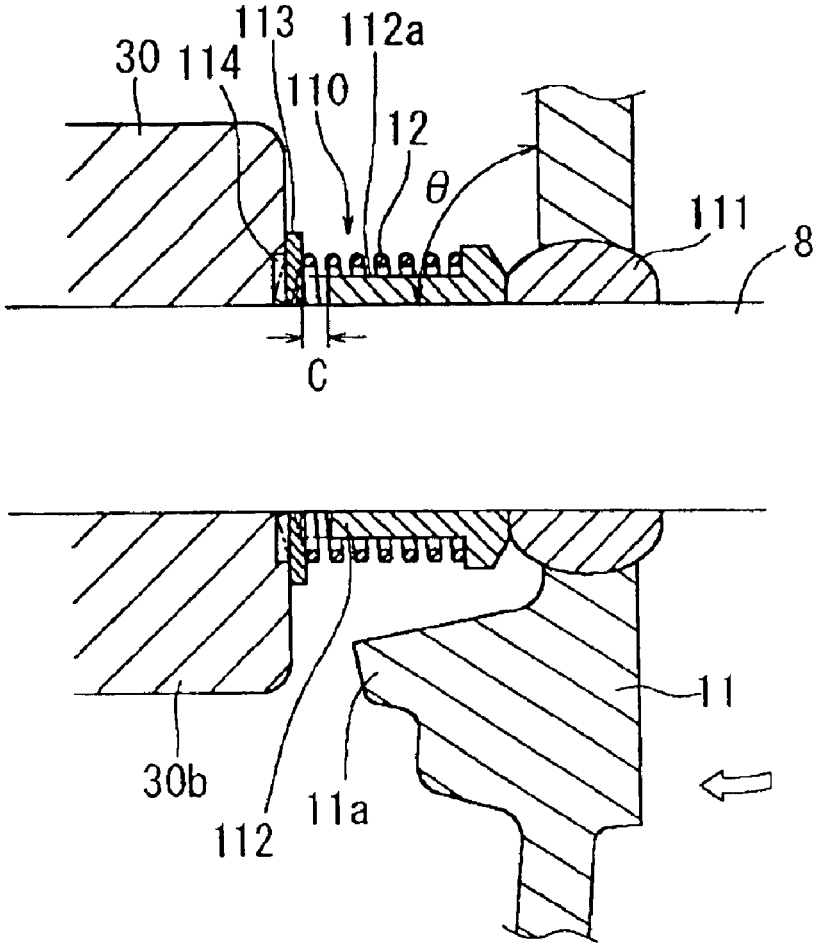
FIG. 10 is a partially enlarged cross-sectional view of a variable displacement compressor according to a seventh embodiment of the present invention.
Figure 11:
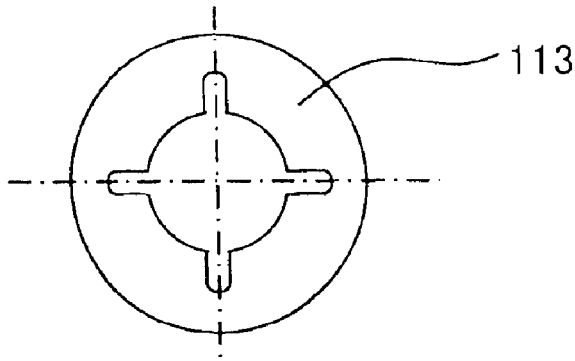
FIG. 11 is an end view showing a leaf spring, which has a through hole for inserting a drive shaft and has slits that radially extend and open inwardly toward the driveshaft.

As shown in FIG. 10, a decelerating mechanism 110 is arranged between the drive shaft 8 and the swash plate 11. The decelerating mechanism 110 includes a metal leaf spring 113 made of a flat plate in place of the coned disc decelerating spring 43 described in the first embodiment. The leaf spring 113 is arranged between the coil spring 12 and the rotor 30. A recess 114 or a space for permitting deformation is formed on the rotor 30 facing the leaf spring 113. The outer diameter of the recess 114 is smaller than that of the leaf spring 113, and the outer diameter 112*a* of a sliding member 112 is enough smaller than that of the recess 114. Thereby, elastic deformation of the leaf spring 113 is permitted when the sliding member 112 contacts with the leaf spring 113. Namely, the decelerating mechanism 110 includes the sliding member 112, the leaf spring 113 and the recess 114. The sliding member 112 is arranged at the rotor 30 side of a sleeve 111. The leaf spring 113 is interposed between the sliding member 112 and the rotor 30. The recess 114 is formed on the axial end of the rotor 30 so as to face the radially inner side of the leaf spring 113.

The spring constant of the leaf spring 113 is greater than that of the coil spring 12. The leaf spring 113 is arranged between the rotor 30 and the sliding member 112 at a predetermined distance C from the axial end surface of the sliding member 112 upon stop of the compressor. As the sliding member 112 moves in accordance with an increase of the inclination angle θ of the swash plate 11, the leaf spring 113 contacts with the axial end of the sliding member 112 from a near maximum inclination angle to a maximum inclination.

According to the above-constructed seventh embodiment, as the sleeve 111 moves in accordance with an increase of the inclination angle θ of the swash plate 11, the sliding member 111 moves in the direction to increase the inclination angle θ while compressing the coil spring 12. When the inclination angle θ of the swash plate 11 reaches the near maximum inclination angle, that is, when the displacement of the compressor reaches the near maximum displacement, the sliding member 112 contacts with the leaf spring 113. After that elastic deformation of the leaf spring 113 restricts the swash plate 11 to increase the inclination angle θ. Namely, the leaf spring 113 decelerates the inclination speed of the swash plate 11 by resisting against the inclination of the swash plate 11 in a range from a near maximum inclination angle to the maximum inclination angle. Then, the maximum inclination angle of the swash plate 11 is restricted by contacting the radially inner end of the leaf spring 113 with the bottom of the recess 114 (indicated by two-dotted line in FIG. 10).

According to the seventh embodiment in which elastic deformation of the leaf spring 113 is utilized, for example, even when the inclination angle θ of the swash plate 11 rapidly increases from the minimum inclination angle to the maximum inclination angle upon starting the compressor, noise of collision upon contacting the stopper portion 11*a* of the swash plate 11 with the receiving portion 30*b* of the rotor 30 is effectively reduced and inhibited.

The maximum inclination angle of the swash plate 11 is determined by the depth of the recess 114 into the rotor plate that restricts elastic deformation of the leaf spring 113. The maximum inclination angle of the swash plate 11 may be regulated by rigidity of the leaf spring 113. In such a state, compression reactive force applied to the pistons 15 is inhibited from being periodically transmitted to the front housing 2 by absorbing the force in the range of elastic deformation of the leaf spring 113. Thereby, vibration of the compressor is inhibited, as well as that of the first embodiment.

Also, when the flat plate leaf spring 113 is employed as a decelerating spring, accuracy of the thickness of the plate can easily be accomplished, as compared with the decelerating spring constituted of the coned disc spring 43. Additionally, the amount of elastic deformation of the leaf spring 113 can be set by the depth of the recess 114. Thereby, accuracy on the amount of deceleration in the range from the near maximum inclination angle to the maximum inclination angle improves.

The present invention is not limited to the embodiments described above but may be modified into the following examples.

For example, in the first embodiment, the decelerating spring 43 constituted of a coned disc spring is arranged between the rotor 30 and the sliding member 42. However, as far as the decelerating spring 43 can slide along the drive shaft in the direction of the axis L, the decelerating spring 43 may be arranged between the sliding member 42 and the swash plate 11. Likewise, the vibration damping washer 53 in the second embodiment and the decelerating spring 63 constituted of a coil spring in the third embodiment are the same as described above.

The decelerating mechanisms 40, 50, 60, 70 and 110 arranged on the drive shaft 8 may be arranged between the swash plate side member and the rotor side member in the hinge mechanism 20 and may be arranged between the stopper portion 11*a* of the swash plate 11 and the receiving member 30*b* of the rotor 30.

In the seventh embodiment, at least a slit may be formed to radially extend and open to the radially inner side that engages with the drive shaft 8. Then the spring constant of the leaf spring 113 may be adjusted by increasing the number of the slits or by varying the length of the slit.

In the seventh embodiment, the leaf spring 113 is arranged between the rotor 30 and the sliding member 112, and the recess 114 or a space for permitting deformation to permit elastic deformation of the leaf spring 113 is formed on the rotor 30. However, the leaf spring 113 may be arranged between the sliding member 112 and the sleeve 111, and the recess 114 may be formed on the axial end of the sleeve 111.

Therefore, the present examples and embodiments are to be considered as illustrative and not restrictive, and the invention is not to be limited to the details given herein but may be modified within the scope of the appended claims.

What is claimed is:

1. A variable displacement compressor comprising:

a housing including a cylinder bore;

a drive shaft supported by the housing;

a rotor secured to the drive shaft;

a swash plate operatively connected to the rotor and the drive shaft so as to rotate with the rotor and the drive shaft, the swash plate varying an inclination angle relative to the drive shaft;

a piston connected to the swash plate so as to reciprocate in the cylinder bore with rotation of the swash plate, a stroke of the piston varying in accordance with the inclination angle of the swash plate;

a spring for reducing the inclination angle of the swash plate; and a decelerating mechanism decelerating an inclination speed of the swash plate in a range from a near maximum inclination angle to a maximum inclination angle when the swash plate inclines to increase the stroke of the piston, wherein the decelerating mechanism is arranged between the rotor and the swash plate, wherein the decelerating mechanism includes a decelerating spring, which is provided separately from the spring for reducing the inclination angle of the swash plate, and the spring constant of the decelerating spring is greater than that of the spring for reducing the inclination angle of the swash plate.

2. The variable displacement compressor according to claim 1, wherein compression reactive force applied to the piston is transmitted to the housing through the swash plate and the rotor, and the decelerating mechanism damps the motion created by the compression reactive force.

3. The variable displacement compressor according to claim 1, wherein the decelerating spring is a leaf spring that decelerates the inclination speed of the swash plate by elastic deformation of the leaf spring in accordance with movement of the swash plate, the leaf spring is allowed to elastically deform into a space defined between the rotor and the swash plate, and the elastic deformation is permitted by the space.

4. The variable displacement compressor according to claim 3, wherein the amount of elastic deformation is limited by a depth of the space.

5. The variable displacement compressor according to claim 3, wherein the leaf spring includes a slit that radially extends and opens to a radially inner side of the leaf spring, and the spring constant of the leaf spring is adjusted by one of the number of slits and the length of the slit.

6. The variable displacement compressor according to claim 1, wherein the decelerating spring is a coned disc spring that decelerates the inclination speed of the swash plate by elastic deformation in accordance with movement of the swash plate.

7. The variable displacement compressor according to claim 1, wherein the decelerating spring is a coil spring that decelerates the inclination speed of the swash plate by elastic deformation in accordance with movement of the swash plate.

8. The variable displacement compressor according to claim 1, wherein the decelerating spring is a vibration damping and one of rubber and resin, which are layered, and the vibration damping washer decelerates the inclination angle of the swash plate by elastic deformation in accordance with movement of the swash plate.

9. The variable displacement compressor according to claim 1, wherein the decelerating spring when maximumly compressed limits the swash plate to a maximum inclination angle.

10. The variable displacement compressor according to claim 1, wherein stiffness of the decelerating spring limits the swash plate to a maximum inclination angle.

11. The variable displacement compressor according to claim 1, wherein urging force of the decelerating spring increases in accordance with an increase of the inclination angle of the swash plate.

12. The variable displacement compressor according to claim 1, wherein the number of the cylinder bores is three.

* * * * *

UNITED STATES PATENT AND TRADEMARK OFFICE

CERTIFICATE OF CORRECTION

PATENT NO. : 6,923,626 B2
DATED : August 2, 2005
INVENTOR(S) : Ota et al.

It is certified that error appears in the above-identified patent and that said Letters Patent is hereby corrected as shown below:

Column 5,
Line 30, please delete "a stopper portion **11*i* a" and insert therefore -- a stopper portion 11*a*** --.

Column 9,
Line 18, please delete "in the rang" and insert therefore -- in the range --.

Signed and Sealed this

Fifteenth Day of November, 2005

JON W. DUDAS
*Director of the United States Patent and Trademark Office*